US007217331B2

(12) United States Patent
Jambu et al.

(10) Patent No.: US 7,217,331 B2
(45) Date of Patent: May 15, 2007

(54) METHOD FOR SHAPING STRUCTURES COMPRISED OF ALUMINUM ALLOYS

(75) Inventors: Stephane Jambu, Munich (DE); Knut Juhl, Bremen (DE); Blanka Lenczowski, Neubiberg (DE)

(73) Assignee: Airbus Deutschland GmbH, Hamburg (DE)

( * ) Notice: Subject to any disclaimer, the term of this patent is extended or adjusted under 35 U.S.C. 154(b) by 449 days.

(21) Appl. No.: 10/381,476

(22) PCT Filed: Aug. 25, 2001

(86) PCT No.: PCT/EP01/09821

§ 371 (c)(1),
(2), (4) Date: Oct. 14, 2003

(87) PCT Pub. No.: WO02/26414

PCT Pub. Date: Apr. 4, 2002

(65) Prior Publication Data

US 2004/0050134 A1 Mar. 18, 2004

(30) Foreign Application Priority Data

Sep. 26, 2000 (DE) ..... 100 47 491

(51) Int. Cl.
*B21B 33/02* (2006.01)

(52) U.S. Cl. ..... 148/695; 148/698; 72/364

(58) Field of Classification Search ..... 72/364; 148/695, 698, 697

See application file for complete search history.

(56) References Cited

U.S. PATENT DOCUMENTS 4,188,811 A 2/1980 Brimm ..... 72/63
5,168,169 A 12/1992 Brewer, Jr. et al. ..... 364/474
5,620,652 A * 4/1997 Tack et al. ..... 420/532
6,972,110 B2 * 12/2005 Chakrabarti et al. ..... 420/532

FOREIGN PATENT DOCUMENTS

| | | |
|---|---|---|
| DE | 195 04 649 | 8/1996 |
| EP | 0 517 982 | 12/1992 |
| EP | 0 527 570 | 2/1993 |
| FR | 2 696 967 | 4/1994 |

OTHER PUBLICATIONS

Friedrich Ostermann, "Anwendungstechnologie Aluminum", 1998, pp. 59-68, Springer Verlag, ISBN 3-540-62706-5.

(Continued)

*Primary Examiner*—Roy King
*Assistant Examiner*—Janelle Morillo
(74) *Attorney, Agent, or Firm*—Crowell & Moring LLP

(57) ABSTRACT

A method is provided for forming complex structures from aluminum alloys, particularly from naturally hard AlMg alloys, naturally hard AlMgSc alloys and/or age-hardenable AlMgLi alloys. The method, in a simple manner by means of as few process steps as possible, forms complex structures from the alloys such that they almost assume their final shape without any significant spring-back. Simultaneously, the loss of material is to be kept as low as possible. This is achieved by means of the following steps: elastic forming of a component to be formed into a defined contour under the effect of external force; and heating-up of the elastically formed component to a temperature higher than the temperature required for a creep formation and relaxation of stresses of the alloy, so that the component is formed while retaining the contour.

15 Claims, 1 Drawing Sheet

OTHER PUBLICATIONS

D.M. Hambrick "Age Forming Technology Expanded in an Autoclave", *SAE Technical Paper Series*, General Aviation Aircraft Meeting and Exhibition, Wichita, Kansas, Apr. 16-19, 1985, No. 850885.

Holman, M.C. "Autoclave Age Forming Large Aluminum Aircraft Panels", Journal of Mechanical Working Technology, Amsterdam, NL, Bd. 20, 1989, pp. 477-488 (XP000749608).

* cited by examiner

METHOD FOR SHAPING STRUCTURES COMPRISED OF ALUMINUM ALLOYS

BACKGROUND AND SUMMARY OF THE INVENTION

The present invention relates to a method of forming structures made of aluminum alloys, particularly of naturally hard AlMg alloys, naturally hard AlMgSc alloys and/or age-hardenable AlMgLi alloys.

In aeronautical and aerospace engineering, complex structures of high strength and stiffness are required which, taking into account their weight as well as aerodynamic aspects, should have an optimal design. Such structures or structural parts include, for example, wing shell surfaces, covering and tank elements for spacecraft, airplane fuselage surfaces with structure reinforcing elements, such as stringers and ribs. As a rule, a manufacturing of such structural parts made of aluminum alloys which has precise contours and corresponds to the drawings is difficult and usually requires several forming steps for the individual components with corresponding intermediate annealing treatments.

The conversion of welded integral constructions in the construction of airplanes requires the use of readily weldable corrosion-resistant materials, such as AlMgSc and AlMgLi alloys. Because of their spectrum of characteristics, these alloys only have a very limited ductility. As a result, a shaping into the desired end contour is partly not possibly by means of conventional methods because the capacity for deformation is insufficient.

It is today's state of the art that the shell areas are formed from metal plates of Alloy AA2024 in the solution-heat-treated condition by means of stretch-forming. It is known that, during stretch-forming, which can be carried out in the cold as well as in the warm condition, the structure to be formed is formed in one or several steps or phases (compare German Patent Document DE 195 04 649 C1). In this case, the structure to be formed can first be stretched in the longitudinal direction and subsequently over a structural part which has the desired end contour.

It is disadvantageous in this case, that as a result of the forming operation, internal tensions are created in the material which, when operating loads are superimposed, may lead to a failure of the structure. Furthermore, a forming into a structure with a spherical curvature, that is, with curvatures along different directions in space, presents difficulties and requires correspondingly designed machines and dimensionally stable tools. In addition, the structure to be formed is usually damaged by the mounting of clamping jaws on the outer edges so that these areas have to be removed, for example, by means of contour milling. This not only results in a loss of material but also requires another machining step which leads to unnecessary expenditures and a connected time consumption.

In addition, in the case of the AlMg alloys, when the forming takes place at room temperature, a discontinuous deformation is observed as well as the forming of characteristic surface phenomena which are also called Luder's lines and may have a disturbing effect on the characteristics of the material.

It was also found that the group of the AlMg alloys have a planar anisotropy with an r-value minimum in the L-direction (rolling direction). This means that the material flow during the stretch forming for the most part takes place from the metal plate thickness and the structure to be formed therefore tends to thin out locally earlier and fail at a premature point in time. In addition, the reduction of the metal plate thickness by stretching has the result that the reaching of a final thickness which corresponds to the drawings can be achieved only by means of uniform degrees of stretching and is therefore difficult to implement in the case of components with large development differences.

It is known that, in addition to stretch forming, an age hardening process is used which is carried out, for example, under the effect of pressure and temperature in an autoclave or furnace and during which an age-hardening effect occurs simultaneously. This so-called "age forming" process is used for age-hardenable Al alloys of the 2xxx, 6xxx, 7xxx and 8xxx series. In this case, an elastic forming of the structure to be formed first takes place under the effect of pressure or force. The structure to be formed conforms to a structural part which has a smaller radius of curvature than the finished component in order to take into account the so-called "spring-back" effect. Therefore, the structure to be formed is first formed beyond its desired final shape. As a result of the subsequent heating to the alloy-specific age-hardening temperature, a deformation takes place with a partial relaxation of tensions, as described, for example, in the article by D. M. Hambrick "Age Forming Technology Expanded in an Autoclave", *SAE Technical Paper Series*, General Aviation Aircraft Meeting and Exhibition, Wichita, Kans., Apr. 16–19, 1985, NO. 850885. This has the result that the component springs back to a certain degree during the cooling and will only then assume its final shape. Thus, after the cooling and relieving, the formed structure has a larger radius of curvature than before the heating. This is problematic mainly for the manufacturing of structural parts because the "spring-back" effect has to be predicted with high precision in order to design the structural part in such a manner that the finished component finally assumes the desired final shape. This, in turn, requires a high-expenditure simulation of the "spring-back" effect, as described, for example, in European Patent Documents EP 0517982A1 and EP 0527570B1.

In addition to the age-hardenable alloys used today (for example, AA2024, AA6013, AA6056), new naturally hard, that is, non-age-hardenable alloys have been developed for future airplane generations, which, in contrast to the established alloys, for metallurgical reasons, cannot be solution-heat-treated because this would lead to an irreversible loss of strength. Thus, the new materials cannot be formed without problems by means of conventional methods. As a result, alternatives are required for the production of double-curved or spherical shell areas.

It is therefore an object of the present invention to provide a method by means of which complex structures of the alloys according to the invention can be formed in a simple manner, that is, with as few process steps as possible, without any significant spring-back effect. At the same time, the loss of material as a result of additional machining should be as low as possible.

According to the invention, this object is achieved in that a component which is to be formed and which consists of the alloys according to the invention is elastically formed under the effect of external force and in the process takes up its desired final shape, and in that the elastically formed component is then heated to a temperature which is higher than the temperature required for the creep forming and the relaxation of tensions of the alloy, so that, if possible, the component is formed while retaining its final shape.

In this manner, it is achieved that the component is formed under the effect of heat without any significant spring-back and in the process almost completely retains the final shape impressed by the elastic forming. After the forming and subsequent cooling, the component therefore basically has the same curvature as before the heat treatment. This has the advantage that the structural parts or holding devices used for the elastic forming, with sufficient precision, have the same shape as the theoretical shape of the component and thus a complex simulation for predicting the "spring-back" effect is not required.

The elastic forming of the component before the heat treatment, in which case the component already assumes its desired final shape, can be implemented according to a first embodiment such that, after the component to be formed is inserted into a holding device, an external force acts upon the component, after which the component conforms to the contour of the holding device while being formed elastically. The external force may be transmitted by way of a mechanical pressure or stamping device which presses the component in the direction of the holding device. As an alternative, the elastic forming can take place directly by the effect of an external pressure which is generated, for example, in an evacuated space.

According to another embodiment, it is expedient that an external force act in such a manner upon the component inserted into the holding device that the component bends elastically in the direction of the holding device so that a hollow space is created between the component and the holding device. This hollow space is then sealed off by means of a sealing material and is then evacuated. Because of the resulting vacuum, the component, while being elastically formed, conforms completely to the contour of the holding device and assumes the desired final shape. Subsequently, under the effect of heat, the forming of the component takes place at temperatures which are above the temperature required for the creep forming and the relaxation of tensions of the alloy.

The advantage is therefore not only that the contour of the holding device corresponds to the desired final shape of the component to be formed but also the forming is of a purely elastic nature as a result of the effect of the external forces. This means that the component returns to its original shape when it is no longer affected by external forces. As a result, corrections or another insertion can take place without any problem. The elastic forming of the component by the effect of the external forces can therefore be repeated at any time.

It is also expedient to heat the component at a heating-up rate of from 20° C./s to 10° C./h to a maximal temperature above the temperature required for the creep forming and relaxation of tensions of the alloy and subsequently cool the component at a rate of between 200° C./s to 10° C./h. The maximal temperature is preferably between 200° C. and 450° C. and is typically kept constant for a time period of from 0 to 72 hours.

In this case, it is advantageous that, within the above-mentioned ranges, the heating-up and cooling rate respectively as well as the maximal temperature can be adapted to the used alloy or to the desired physical properties. In addition, after the implementation of the method, another forming of the component can take place which is not possible or is possible only to a limited extent by means of the known methods.

Another advantage of the method according to the invention is the fact that singly curved as well as spherical structures can be formed in one working step. For this purpose, the holding device has curvatures which extend in different directions in space and correspond to the finished final contour of the component to be formed. Furthermore, in addition to 2D structures, complex 3D structures, on which stringers and ribs are already fastened, can be formed in a simple manner. Simultaneously, deformations caused by thermal stress resulting from a preceding welding operation are compensated by the forming process according to the invention.

BRIEF DESCRIPTION OF THE DRAWINGS

In the following, the invention will be explained in detail by means of the attached drawings.

DETAILED DESCRIPTION OF THE DRAWINGS

Figure 1:
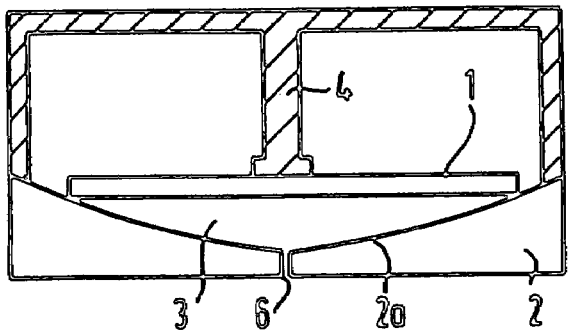
FIG. 1 is a schematic representation for explaining the insertion of a component to be formed into a holding device.

FIG. 1 is a schematic representation for explaining the insertion of a component 1 to be formed into a holding device 2. The component 1 to be formed may be a two-dimensional metal plate made of a hard-rolled naturally hard material. Likewise, stiffening elements (not shown) may be mounted on the metal plate by means of friction agitation welding, laser welding or other suitable methods, so that the structure to be formed has a three-dimensional design. In this case, the metal plate is inserted into the holding device 2 in such a manner that the reinforcing structures point away from the holding device 2. Generally, any arbitrary complex three-dimensional structure can be placed in the holding device for the forming, which structure consists in particularly of a naturally hard, that is, non-age-hardenable aluminum alloy. These non-age-hardenable aluminum alloys may be AlMg alloys, or particularly AlMgSc alloys. However, age-hardenable AlMgLi alloys may also be used.

The holding device 2, into which the component 1 to be formed is inserted, has a shape or contour 2*a* which corresponds to the desired final shape of the formed component 1. In the following, the final shape of the component 1 will have the reference number 1*a*. The curvature of the holding device 2 may extend in the plane illustrated in FIG. 1 as well as in the plane perpendicular thereto, so that a component can also be formed into a final shape with a spherical or double curvature in one working step.

The component 1 is first placed into the holding device 2 in its unformed condition. In this case, a hollow space 3 is formed between the component 1 and the holding device 2. Subsequently, the unformed component 1 is acted upon by a force F from above, that is, from the side of the component opposite the holding device 2. This force F may be transmitted to the component 1, for example, by a stamping or pressure arrangement 4 shown only schematically in FIG. 1. Other suitable devices for an action by this external force are also conceivable. This may, for example, be the effect of an external pressure P within an evacuated space, in which the holding device and the component are situated. A combination of forces F and P is also conceivable.

Figure 2:
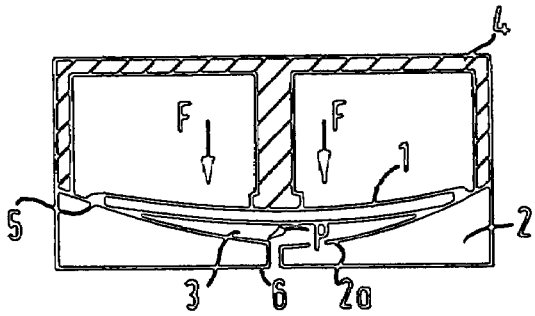
FIG. 2 is a schematic representation for explaining the effect of an external force on the component to be formed.

As a result of the effect of the external force F and/or P, the component 1 is elastically deformed such that it bends in the direction of the holding device 2. As illustrated in FIG. 2, in this case, the radius of curvature of the elastically deformed component 1 is greater than that of the holding device 2, so that, in addition, a hollow space 3 exists between the component 1 and the holding device 2. However, the volume of the hollow space 3 is smaller in comparison to the starting condition illustrated in FIG. 1.

The elastic forming of the component 1 by the effect of the external forces also has the result that the supporting surface between the component 1 and the holding device 2 becomes larger and the hollow space 3 can therefore be closed off in an airtight manner by using a sealing material 5. The sealing material 5 is typically a temperature-stable modified silicone material which is applied to the edge area of the component 1.

Figure 3:
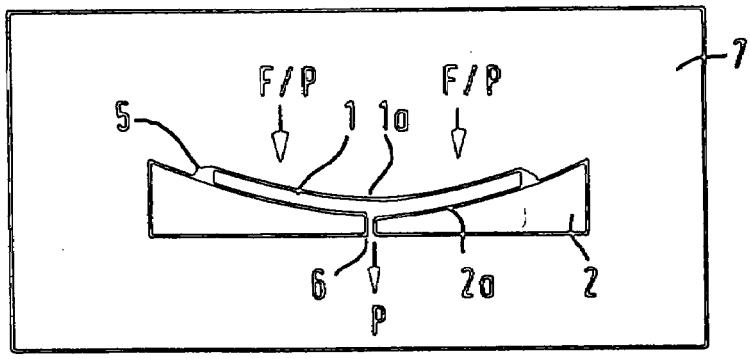
FIG. 3 is a schematic representation of the forming step according to the invention.

After the sealing-off, the hollow space 3 between the component 1 and the holding device 2 is evacuated. For this purpose, penetrations 6 are arranged in the holding device 2, by way of which penetrations 6, the hollow space 3 is connected to a vacuum pump (not shown). As a result of the evacuation, a vacuum p is created in the hollow space, whereby the component 1 is pulled farther in the direction of the holding device 2, until it rests completely against the contour 2*a* of the holding device 2, as illustrated in FIG. 3. It is noted that the pressure or stamping arrangement was not shown in FIG. 3. Furthermore, the arrangement is situated in a closed housing 7, which may be a furnace, an autoclave or the like.

In this context, it should also be noted that, in cases in which the external force or the external forces F and/or P is/are sufficient for pressing the component completely against the contour 2*a* of the holding device 2, the evacuation of the hollow space will not be necessary. This applies, for example, when thin metal sheets or slightly curved structures are formed.

Also in the condition illustrated in FIG. 3, the component 1 first is in the elastically formed condition, so that the forming is reversible and the process could be repeated if an external force were no longer acting upon the component; that is, when an external force no longer acts upon the component to be formed, the latter will return into its unformed original starting position. Corrections can therefore be made at any time without any problem.

After the component was brought into its final shape, while being elastically formed, by means of the above-mentioned steps, the component 1 is heat-treated inside the closed housing 7 while the vacuum is maintained. By means of the heating, the component 1 is formed, while the tensions entered into the material during the elastic forming are relaxed. After the conclusion of the relaxation of tensions by the heat effect, the vacuum can be disconnected and a cooling phase follows. In this case, the component retains almost the final shape 1*a* defined by the contour of the holding device, without the occurrence of a significant spring-back.

Figure 4:
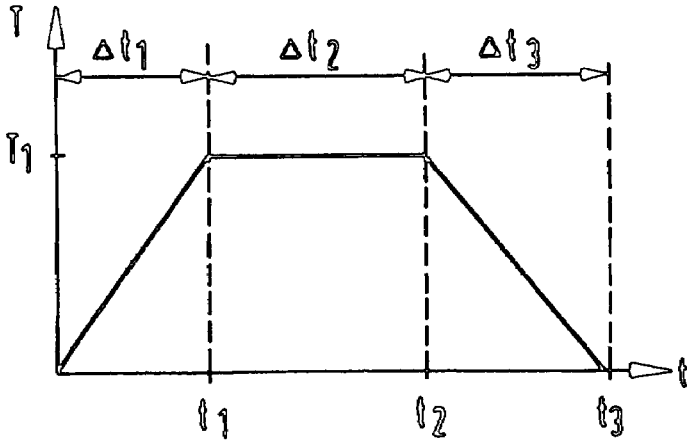
FIG. 4 is a T(t) diagram of the heat treatment required for the forming of the component.

In this case, the heat treatment takes place according to the schematic T(t) course illustrated in FIG. 4. In the evacuated condition, that is, the component 1 conforms completely to the contour 2*a* of the holding device 2, the component 1 is heated to a maximal temperature $T_1$ which is above the temperature required for the creep forming and the relaxation of tensions of the alloy, which typically is higher than or equal to 200° C. In this case, the component is heated at a heating-up rate of between 20° C./s and 10° C./h within a first time interval $\Delta t_1$ to the desired target temperature $T_1$. In contrast to the continuous course illustrated in FIG. 4, the heating-up rate within the interval $\Delta t_1$ may also vary in a step shape or in any other suitable manner. The maximal temperature Ti, which is typically between 220° C. and 450° C., is reached at the point in time $t_1$. This temperature is then kept constant for a time period $\Delta t_2$, which is typically between 0 and 72 h. The essential relaxation of tensions of the component takes place within this time interval $\Delta t_2$. After the expiration of this time interval, that is, at the point in time $t_2$, the vacuum can be disconnected and a cooling phase at a rate of typically 200° C./s to 10° C./h follows. As schematically illustrated in FIG. 4, the cooling can take place continuously or in steps. In this case, the cooling can take place by normal air cooling or in a different suitable manner.

It essential that, during the cooling process, the component almost completely retains its final shape 1*a* defined by the contour 2*a* of the holding device 2. A significant spring-back in the form of a larger radius of curvature than the holding device does not occur. Thus, the holding device can be produced with sufficient precision with the dimensions of the desired final shape. A complicated simulation of the spring-back effect, as required, for example, in the case of conventional age-hardenable alloys, which are formed by means of the "age forming" method, will not be necessary.

As initially indicated, components to be formed do not necessarily only have to be two-dimensional metal plates made of the above-mentioned aluminum alloys but may also have three-dimensional shapes which can be formed into a desired double-curved or spherical shape. A high-expenditure manufacturing of curved parts before the welding operation is therefore not necessary. Previously, this had been required because the metal plates and the stringers were connected, for example, by means of laser welding in the condition close to the final contour.

Furthermore, a distortion of the component caused by laser welding, or unevennesses or waviness of the metal plates (also called "Zeppelin Effect"), which are generated, for example, when fastening stringers by means of laser welding processes in the metal plate, are almost completely compensated during the forming process schematically illustrated in FIG. 3. Thus, the method according of the invention also has the advantage that it almost completely compensates such unevennesses without requiring complicated aftertreatment processes or aligning operations.

In addition, the method according to the invention results only in a small loss of material, because the edge areas at the longitudinal edges, at which the stretching force is introduced in the case of the conventional forming methods, do not have to be cut off.

What is claimed is:

1. Method of forming an aluminum based alloy component into a structure having a desired contour, said method comprising:

causing the component to undergo a purely elastic forming under the effect of external force, such that said component conforms to the desired final contour; and after said elastic forming is completed, and commencing with the component already elastically formed in said desired final contour, heating the component to a first temperature higher than a temperature required for a creep forming and relaxation of tensions of the alloy, whereby the component retains the desired final contour after said external pressure and heating are discontinued.

2. Method according to claim 1, wherein the elastic forming comprises the steps of inserting the component to be formed into a holding device having a contour which corresponds to a desired final contour of the component to be formed, causing the action of an external force upon the component, so that, as a result of elastic forming, the component conforms to the contour of the holding device.

3. Method according to claim 1, wherein the elastic forming comprises the steps of inserting the component to be formed into a holding device having a contour which corresponds to a desired final contour of the component to be formed, causing the action of an external force upon the component, so that the component bends elastically in the direction of the holding device, sealing off the hollow space forming between the component and the holding device by means of a sealing material, and evacuating the hollow space so that the component conforms to the contour of the holding device and assumes the desired final contour.

4. Method according to claim 1, wherein the component (1) is heated at a warming-up rate of from 20° C./s to 10° C./h to the first temperature, wherein the first temperature is maintained for a time period of between 0and 72 h, and wherein subsequently the component is cooled at a rate of from 200° C./s to 10° C./h.

5. Method according to claim 1, wherein the first temperature is between 200° C. and 450° C.

6. Method according to claim 1, wherein the component inserted into the holding device is formed into a component with a singly and doubly curved or spherical contour.

7. Method according to claim 1, wherein complex 2D or 3D structures are inserted into the holding device for the forming.

8. Method according to claim 1, wherein the component to be formed consists of a naturally hard AlMg alloy.

9. Method according to claim 1, wherein the component to be formed consists of a naturally hard AlMgSc alloy.

10. Method according to claim 1, wherein the component to be formed consists of an age-hardenable AlMgLi alloy.

11. Method according to claim 1, wherein the component (1) to be formed consists of a combination of a naturally hard AlMg alloy, a naturally hard AlMgSc alloy, and an age-hardenable AlMgLi alloy.

12. Method of making an aluminum alloy structural component, comprising:

providing a component made of at least one of hard AlMg alloys, naturally hard AlMg Sc alloys and age-hardenable AlMgLi alloys, deforming the component in a purely elastic deformation, to conform a desired final contour by applying an external force, and heating the elastically formed component to a temperature and for a time sufficient to creep form and relax tensions of the alloy of the component while retaining the desired final contour, whereby said component retains the desired final contour after said heating.

13. Method according to claim 12, wherein the elastically deforming comprises:

inserting the component to be formed into a holding device having a contour which corresponds to a desired final contour of the component to be formed, causing the action of an external force upon the component, so that, as a result of elastic forming, the component conforms to the contour of the holding device.

14. Method according to claim 12, wherein the elastically deforming comprises:

inserting the component to be formed into a holding device having a contour which corresponds to a desired final contour of the component to be formed, causing the action of an external force upon the component, so that the component bends elastically in the direction of the holding device, sealing off the hollow space forming between the component and the holding device by means of a sealing material, and evacuating the hollow space so that the component conforms to the contour of the holding device and assumes the desired final contour.

15. A method of forming an aluminum based alloy component into a desired final contour, said method comprising:

first, elastically deforming said component into said desired final contour; and thereafter heating said component to a first temperature higher than a temperature required for creep forming of the alloy and relaxation of tensions within the component, whereby said component retains the desired final contour after said heating;

wherein, said step of elastically deforming the component comprises a purely elastic deformation which causes the component to assume the desired final contour.

* * * * *